US009650746B2

(12) United States Patent
Kuo et al.

(10) Patent No.: US 9,650,746 B2
(45) **Date of Patent: *May 16, 2017**

(54) PULP MOLDING PROCESS AND PAPER-SHAPED ARTICLE MADE THEREBY

(71) Applicant: GOLDEN ARROW PRINTING CO., LTD., New Taipei (TW)

(72) Inventors: Chien-Kuan Kuo, New Taipei (TW); Chun-Huang Huang, New Taipei (TW)

(73) Assignee: GOLDEN ARROW PRINTING CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/936,856

(22) Filed: Nov. 10, 2015

(65) Prior Publication Data

US 2016/0362845 A1 Dec. 15, 2016

Related U.S. Application Data

(60) Provisional application No. 62/174,260, filed on Jun. 11, 2015.

(51) Int. Cl.
*D21J 3/00* (2006.01)
*D21J 3/12* (2006.01)
*D21H 21/18* (2006.01)

(52) U.S. Cl.
CPC ..... *D21J 3/12* (2013.01); *D21H 21/18* (2013.01)

(58) Field of Classification Search
CPC ..... D21J 3/00; D21J 3/12; D21J 7/00; C09J 7/04
USPC ..... 162/146
See application file for complete search history.

(56) References Cited

U.S. PATENT DOCUMENTS 4,865,913 A * 9/1989 Takeuchi ..... B41M 5/38278 428/212
5,269,866 A * 12/1993 Kushida ..... B41M 5/38228 156/234
5,350,474 A * 9/1994 Yamane ..... B41J 2/32 156/230
5,393,872 A * 2/1995 Shinoki ..... B32B 5/26 162/157.3
5,409,758 A * 4/1995 Hiyoshi ..... B41M 5/44 428/318.4
2002/0042021 A1* 4/2002 Okano ..... B41N 3/00 430/273.1
2012/0308744 A1* 12/2012 Depres ..... B41M 5/52 428/32.2
2014/0322500 A1* 10/2014 Depres ..... B32B 29/06 428/195.1
2016/0168793 A1* 6/2016 Kuo ..... D21J 3/12 162/227
2016/0168800 A1* 6/2016 Kuo ..... D21J 3/00 162/218
2016/0168801 A1* 6/2016 Kuo ..... D21J 3/00 162/194

* cited by examiner

*Primary Examiner* — Mark Halpern
(74) *Attorney, Agent, or Firm* — Osha Liang LLP

(57) ABSTRACT

A pulp molding process and a paper-shaped article made thereby are provided. The pulp molding process comprises the steps of providing a composite having at least one fiber material, performing a pulp-dredging step including a first pre-compression forming step, performing a compression thermo-forming step, and performing an edge-cutting step for forming a paper-shaped article, wherein the composite comprises 20 to 99 parts by weight of a superior short fiber material for forming the paper-shaped article for eliminating the crosslinking effect. The paper-shaped article made by the pulp molding process comprises a cave having a transversal width of from 0.5 mm to 8 mm.

3 Claims, 8 Drawing Sheets

PULP MOLDING PROCESS AND PAPER-SHAPED ARTICLE MADE THEREBY

FIELD OF THE INVENTION

The present invention relates to a pulp molding technology, and more particularly to a pulp molding process for eliminating a crosslinking effect, and also particularly to a paper-shaped article made by the pulp molding process.

BACKGROUND OF THE INVENTION

Please refer to FIG. 1, which is a schematic cross-sectional view of a wet pulp body or a paper-shaped object manufactured by the conventional pulp molding process. Generally, the conventional pulp molding process comprises a pulp-dredging step and a thermo-forming step. In the pulp-dredging step, a pulp-dredging stage 1 is applied to move and dip a mold die 2 into at least one slurry tank (not shown) which is used to store wet paper slurry in liquid. The raw material kind of the paper slurry commonly consists of specific plant fiber, water, other raw materials, and so on. Then, a part of the wet paper slurry is dredged from the slurry tank by the mold die 2 to accumulate a wet pulp body or a very rough paper-shaped object 5 correspondingly onto an upper surface of the mold die 2.

After the pulp-dredging step of dredging up the wet pulp body/paper-shaped object 5 by the mold die 2 from the paper slurry, a little of the wet pulp body may be accumulated above an opening of a shallow cave/groove 3 formed with the wet pulp body 5, to constitute a crosslinking portion 4 (or so-call "bridging") as shown in dotted lines covering the opening of the cave/groove 3, since most of the wet pulp body contains long-length fibers (over 2 mm) which are floated above a narrow/tiny cavity on the mold die 2 correspondingly to the shallow cave/groove 3 so that a crosslinking effect occurs thereabove; especially in the manner when the cave/groove 3 of the wet pulp body 5 needs to be shaped in a thinner cross-sectional width (i.e. below 8 mm) or a deeper depth (as over 8 mm). In actually, the crosslinking effect may occur on two opposite sides of the thinner cross-sectional width of the cave/groove 3.

Secondly, a finished product made from the wet pulp body/paper-shaped object 5 by the rest following manufacturing process (i.e. the thermo-forming step/a tool-cutting/trimming step) has a very rough surface smoothness. For example, the surface smoothness of the inner surface thereof may be larger than over 30 seconds according to a 'Bekk' Smoothness measurement standard. Furthermore, a structure of the paper-shaped object 5/the finished product may crash/be damage easily during the following process (i.e. the thermo-forming step/the tool-cutting/trimming step). Thus, the crosslinking effect will seriously decrease the yield of the paper-shaped object 5/the finished product.

Even though the crosslinking effect might be decreased in part by changing/replacing the raw material kind of the wet paper slurry with the other which has a shorter-length fiber (as less than 2 mm but larger than 1.4 mm), a mechanical strength of the whole paper-shaped object/the finished product constructed with such a shorter-length fiber will be weak which is not enough for forgoing use. Additionally, because the cave/groove 3 is too small, a corresponding broken opening possibly formed with the cave/groove 3 will hugely affect the following process. Moreover, the paper-shaped object manufactured by the conventional molding process and made of the same composite consisting of raw materials will form a smooth surface and a rough surface respectively as both surfaces of the paper-shaped objects. The rough surface reduces the aesthetics of the paper-shaped object.

Furthermore, the conventional pulp molding process comprising the pulp-dredging step and the thermo-forming step needs take a working cycle time of over 200 seconds per each paper-shaped object, thereby resulting in a very lower manufacturing efficiency for mass manufacture requirement.

Therefore, it is necessary to provide a pulp molding process and a paper-shaped article to solve the above problems.

SUMMARY OF THE INVENTION

An object of the present invention is to provide a pulp molding process and a paper-shaped article which can solve a technical problem of the crosslinking effect occurring in part of a wet pulp dredged up by a mold die from paper slurry during the conventional molding process.

In order to solve the aforementioned drawbacks of the prior art, the present invention provides a pulp molding process comprising:

providing a composite having at least one fiber material, which comprises a superior short fiber material and a relatively longer fiber material;

performing a pulp-dredging step of dredging a pulp body made of the composite, by one of a first upper mold and a first lower mold, from a slurry tank carrying a paper slurry containing of the composite;

performing a first pre-compression forming step on the pulp body to form at least one first semi-finished product with a first cave on a surface thereof, by and between the first upper mold and the first lower mold; and performing a compression thermo-forming step on the at least one first semi-finished product to form at least one second semi-finished product, by and between a third upper mold and a third lower mold;

wherein the composite comprises 20 to 99 parts by weight of the superior short fiber material enough to prohibit a crosslinking portion from being formed in/above the first cave.

In the pulp molding process described above, the pulp-dredging step and the first pre-compression forming step are performed in the same working stage applied in the pulp molding process.

In the pulp molding process described above, a fiber length of the superior short fiber material is greater than 0 mm and less than or equal to 1 mm.

In the pulp molding process described above, a fiber length of the superior short fiber material is greater than 0 mm and less than or equal to 0.8 mm In the pulp molding process described above, the superior short fiber material is selected from the group consisting of synthetic fibers, regenerated fibers, nature fibers, microfibers, nanofibers and/or any combinations thereof.

In the pulp molding process described above, the composite comprises an additive which comprises a water retention agent and a paper strength agent.

In the pulp molding process described above, the relatively longer fiber material further comprises a shorter fiber material and/or a longer fiber material, each of which is longer than the superior short fiber material in fiber length, and the composite comprises less than 50 parts by weight of the relatively longer fiber material.

In the pulp molding process described above, a Canadian standard freeness of the first semi-finished product is about greater than 300 csf.

In the pulp molding process described above, before the compression thermo-forming step and after the first pre-compression forming step, the process further comprises a second pre-compression forming step performed on the at least one first semi-finished product by and between a second upper mold and a second lower mold.

In the pulp molding process described above, in the second pre-compression forming step, the at least one first semi-finished product comprises a second cave having a transversal width of from 6 mm to 8 mm.

In the pulp molding process described above, in the first pre-compression forming step, the at least one first semi-finished product comprises the first cave having a transversal width greater than 0 mm and less than 8 mm.

In the pulp molding process described above, in the compression thermo-forming step, the at least one second semi-finished product comprises a third cave having a transversal width of from 6 mm to 8 mm.

In the pulp molding process described above, the process further comprises performing an edge-cutting step on the at least one second semi-finished product to form at least one paper-shaped article with a fourth cave wherein the fourth cave has a transversal width of from 0.5 mm to 8 mm.

In the pulp molding process described above, each working cycle time for performing the pulp-dredging step, the first pre-compression forming step, and the compression thermo-forming step is less than 150 seconds per each of the at least one second semi-finished product object.

In the pulp molding process described above, each working cycle time for performing the pulp-dredging step, the first pre-compression forming step, and the compression thermo-forming step is less than 100 seconds per each of the at least one second semi-finished product.

In order to solve the aforementioned drawbacks of the prior art, the present invention provides a paper-shaped article made by the pulp molding process comprising:

a smooth inner surface having a surface smoothness of the inner surface about 8-10 seconds according to Bekk Smoothness measurement;

a smooth outer surface having a surface smoothness of the outer surface about 7-9 seconds according to Bekk Smoothness measurement; and a cave having a transversal width equal to or greater than 0.5 mm but less than or equal to 8 mm.

In the paper-shaped article described above, a thickness of the paper-shaped article is 0.5 mm to 3 mm.

In the paper-shaped article described above, the paper-shaped article comprises a composite having at least one fiber material, the composite comprises 20 to 99 parts by weight of a superior short fiber material.

In the paper-shaped article described above, a fiber length of the superior short fiber material is greater than 0 mm and less than or equal to 0.8 mm.

In the paper-shaped article described above, the superior short fiber material is selected from the group consisting of synthetic fibers, regenerated fibers, nature fibers, microfibers, nanofibers and/or any combinations thereof.

In the paper-shaped article described above, each working cycle time for performing the pulp molding process including a pulp-dredging step, a first pre-compression forming step, and a compression thermo-forming step is less than 100 seconds per each of the paper-shaped article The present invention has shown that the pulp molding process and the paper-shaped article made by the pulp molding process are able to solve the problem of the crosslinking effect of the wet pulp dredged up by the mold from paper slurry during the pulp-dredging stage and achieving a desirable combination of strength and the surface smoothness of the inner surface and the outer surface suited for the paper-shaped article.

DETAILED DESCRIPTION OF THE PREFERRED EMBODIMENTS

Figure 1:
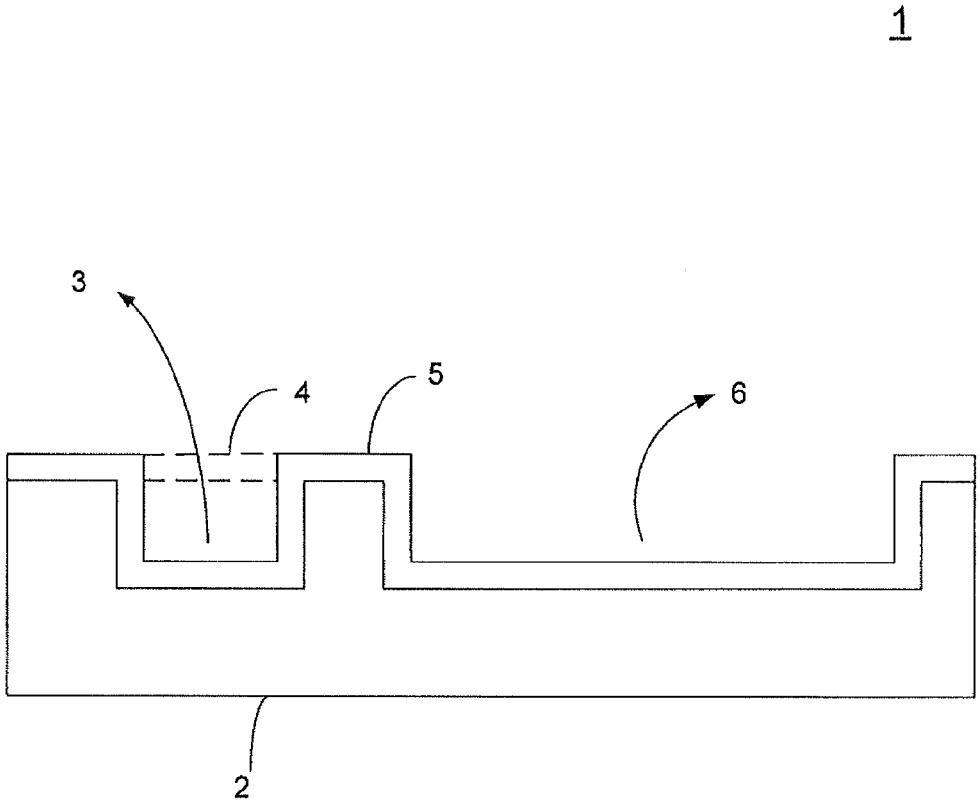
Fig. 1 (PRIOR ART)
FIG. 1 is a schematic view of a crosslinking effect of the wet pulp or the paper-shaped object manufactured by the conventional molding process.

This description of the exemplary embodiments is intended to be read in connection with the accompanying drawings, which are to be considered part of the entire written description. In the description, terms such as "lower," "upper," "horizontal," "vertical,", "above," "below," "up," "down," "top", and "bottom" as well as derivatives thereof should be construed to refer to the orientation as then described or as shown in the drawing under discussion. These terms are for convenience of description and do not require that the apparatus be constructed or operated in a particular orientation, and do not limit the scope of the invention.

Figure 2:
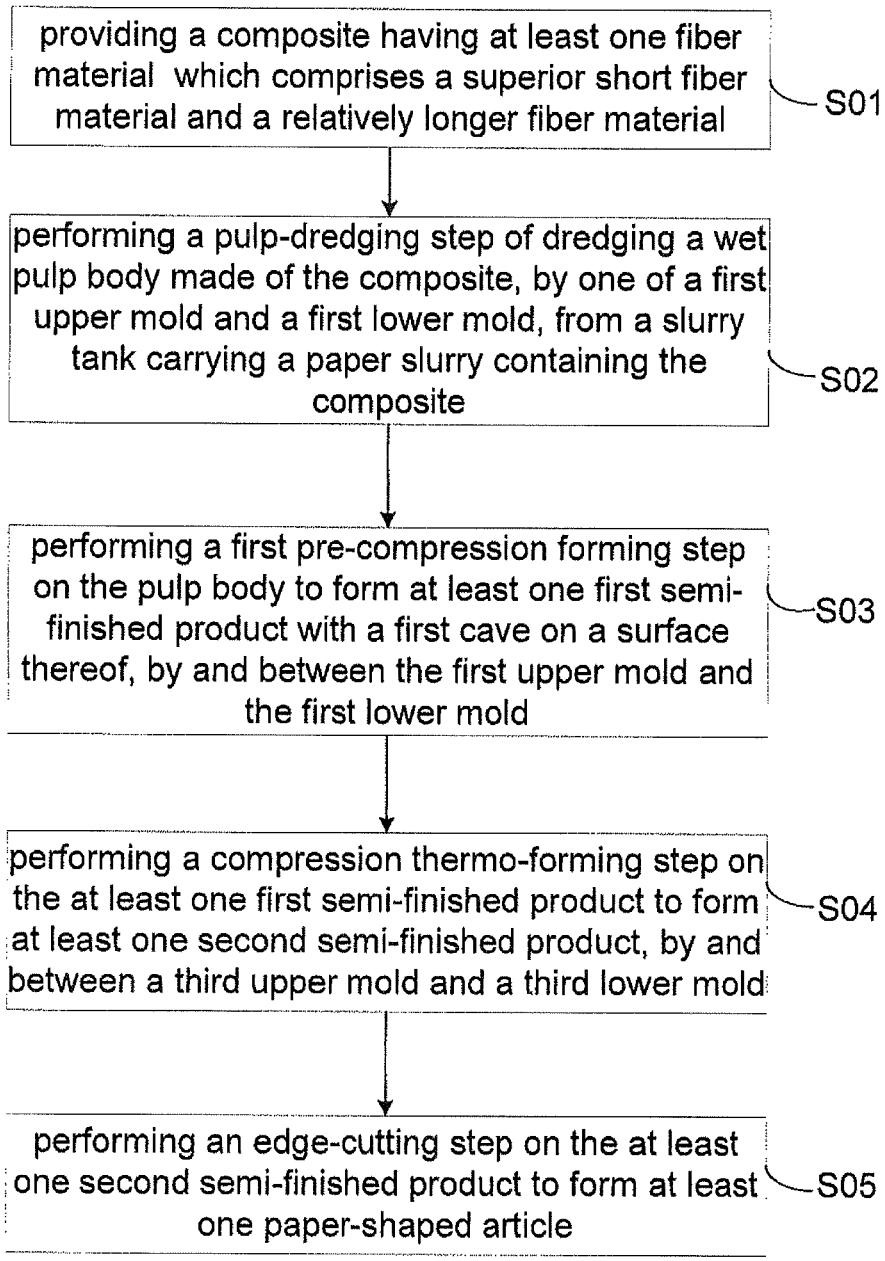
FIG. 2 is a flowchart of a pulp molding process according to a first embodiment of the present invention.

Referring to FIG. 2, which is a flowchart of a pulp molding process according to a first embodiment of the present invention.

A pulp molding process of the present invention comprises the following steps of:

S01: providing a composite having at least one fiber material, which comprises a superior short fiber material and a relatively longer fiber material;

S02: performing a pulp-dredging step of dredging a wet pulp body made of the composite, by one of a first upper mold and a first lower mold, from a slurry tank carrying a paper slurry containing the composite;

S03: performing a first pre-compression forming step on the pulp body to form at least one first semi-finished product with a first cave on a surface thereof, by and between the first upper mold and the first lower mold; and S04: performing a compression thermo-forming step on the at least one first semi-finished product to form at least one second semi-finished product, by and between a second upper mold and a second lower mold;

The composite comprises 20 to 99 parts by weight of the superior short fiber material, and most preferably is 65 to 75 parts by weight of the superior short fiber material, for forming the paper-shaped article without formation of a crosslinking portion above the first cave 201 (shown in FIG. 6A) of the first semi-finished product 101.

Figure 7:
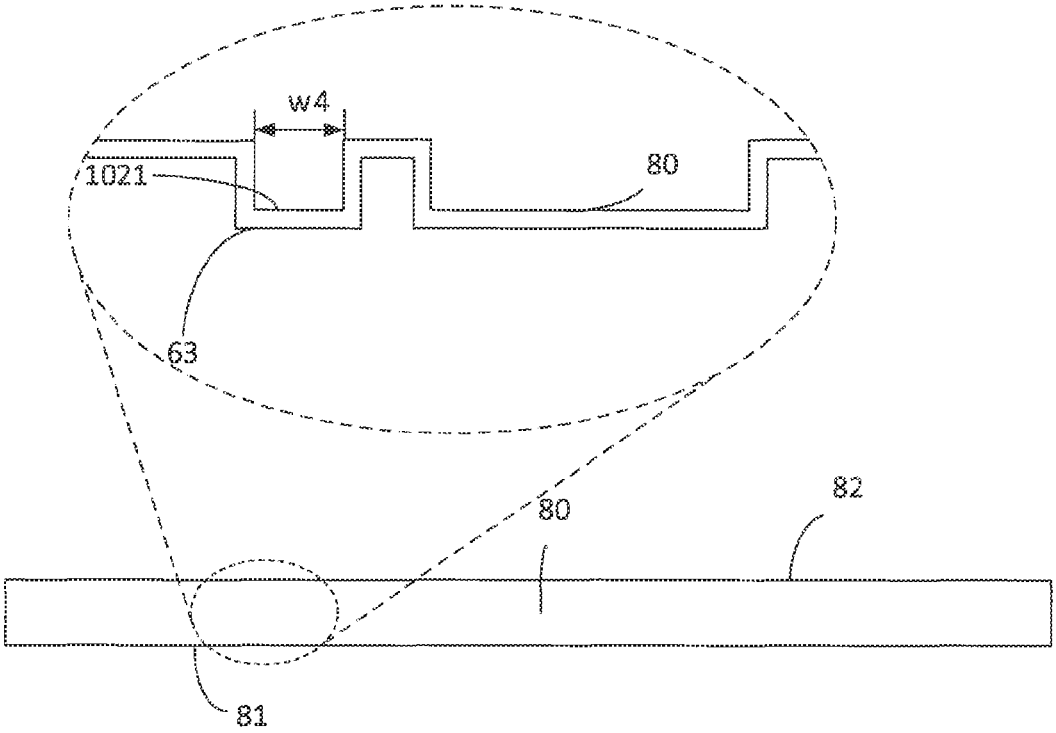
FIG. 7 is a schematic view of the paper-shaped article made by the pulp molding process according to the present invention.

Besides, in this embodiment of the present invention, the process further comprises a step of performing an edge-cutting step S05 for forming a shaped pulp article 80 (shown in FIG. 7).

Figure 3:
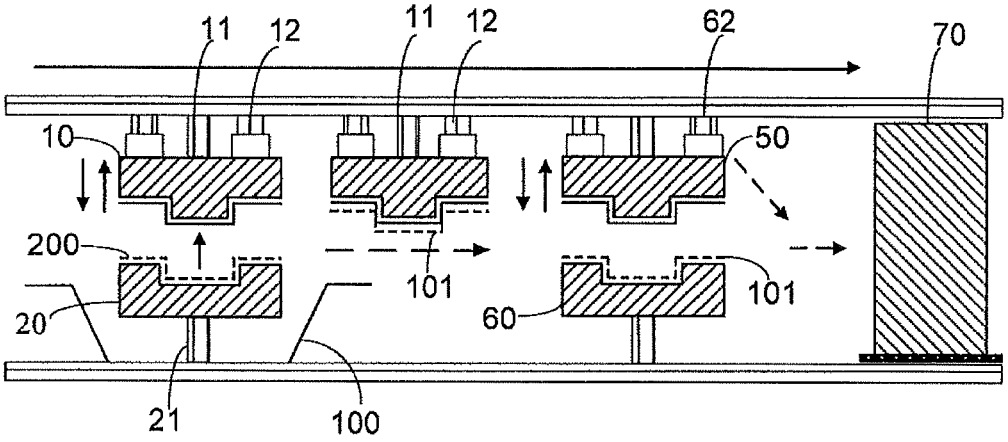
FIG. 3 is a flowchart of a pulp molding process according to the first embodiment of the present invention, which includes a pulp-dredging step, a first pre-compression forming step, a compression thermo-forming step, and an edge-cutting step of the pulp molding process, for forming a paper-shaped article.

Referring to FIG. 3, which is a flowchart of a pulp molding process according to the first embodiment of the present invention, which includes a pulp-dredging step, a first pre-compression forming step, a compression thermo-forming step, and an edge-cutting step for forming a paper-shaped article, that are respectively preformed in different working stages shown in FIG. 3.

In step S01, a fiber length of the superior short fiber material is greater than 0 mm and less than or equal to 1 mm. More precisely, a fiber length of the superior short fiber material is greater than 0 mm and less than or equal to 0.8 mm. Preferably, the fiber length of the superior short fiber material is 0.1 mm to 0.5 mm.

The superior short fiber material may be selected from the group consisting of a synthetic fiber such as polyethylene terephthalate (PET), nylon, polypropylene (PP) and polyethylene (PE), and/or a regenerated fiber such as rayon and tencel, and/or a nature fiber such as wood fiber and non-wood fiber, nature fibers, microfibers, nanofibers and/or any combinations thereof.

The pulp-dredging step and the first pre-compression forming step are performed in the same working stage applied in the pulp molding process. That is to say, the pulp-dredging step S02 which is applied to collect/dredge up a pulp body 200 from a paper slurry tank 100 and further including a first pre-compression forming step S03 which is applied on the dredged pulp body 200 by and between the first upper mold 10 and the first lower mold 20, both kept in a first molding gap (not shown) therebetween, so as to form at least one first semi-finished product 101, and a dryness of the first semi-finished product 101 is about 10%~50%.

In the pulp-dredging step S02, a feeding shaft 21 is adapted for sinking the first lower mold 20 downward into the paper slurry tank 100 to collect/dredge up the pulp body 200 above the first lower mold 20. Then, the first lower mold 20 is moved upward by the feeding shaft 21 to a predetermined position, and the first upper mold 20 is moved downward by a first vertical rack 11 in a close manner to the first lower mold 20, accompanied with performing the first pre-compression forming step S03 where the first upper mold 10 downwardly applies a first compressing force on the dredged pulp body by and between the first upper mold 10 and the first lower mold 20, both kept in the first molding gap therebetween, so as to form the at least one first semi-finished product 101.

The first semi-finished product 101 is suctioned by the first upper mold 10, and the first upper mold 10 with the at least one first semi-finished product 101 is moved upward to an initial position of the pulp-dredging step. Then, the first upper mold 20 is horizontally conveyed by a first horizontal sliding rack 12 to convey and place the at least one first semi-finished product 101 over the third lower mold 60.

It can be understood that the dredged pulp body 200 is formed on a surface of the first lower mold 20. The first lower mold 20 has a shallow cave 23 (shown in FIG. 6A) corresponding to the first cave of the first semi-finished product 101 or corresponding to the cave 201 (shown in FIG. 6A) of the dredged pulp body 200. A transversal width (inner diameter) of the shallow cave 23 is 1 mm to 8 mm.

Then, the compression thermo-forming step S04 which is further applied on the at least one first semi-finished product 101 by and between the third upper mold 50 and the third lower mold 60, both kept in a third molding gap (not shown) therebetween, and less than the first molding gap, so as to form at least one second semi-finished product 102, and a dryness of the second semi-finished product 102 is about 50%-100%.

In the compression thermo-forming step S04, the third upper mold 50 is moved downward in a close manner to the third lower mold 60, accompanied with applying a third compressing force on the at least one first semi-finished product 101 by and between the third upper mold 50 and the third lower mold 60, both kept in the third molding gap therebetween and less than the first molding gap.

In addition, the at least one first semi-finished product 101 is heated by a heater (not shown) located above the third lower mold 60, drawing the water/vapor out from the at least one first semi-finished product 101 between the third upper and third lower molds 50, 60, so as to form the at least one second semi-finished product 102. Then, the third upper mold 50 with the at least one second semi-finished product 102 is conveyed to perform the edge-cutting step by a third horizontal sliding rack 62.

The edge-cutting step S05 which is further applied on the at least one second semi-finished product 102 by a chopper 70 to form the paper-shaped article 80 (shown in FIG. 7).

For eliminating the crosslinking effect and manufacturing the paper-shaped article having high aesthetics, in addition to adapting the superior short fiber material for forming the paper-shaped article, the composite comprises an additive which comprises a water retention agent and a paper strength agent, further for increasing the printability and dry strength of the paper-shaped article. Furthermore, in different embodiments of the present invention, the relatively longer fiber material can comprise a shorter fiber material and/or a longer fiber material, each of which is longer than the superior short fiber material in fiber length. Besides, the composite comprises less than 50 parts by weight of the relatively longer fiber material. Thus, the paper-shaped article has a Canadian standard freeness is about greater than 300 csf, preferably 470 csf to 550 csf.

In the first preferred embodiment of the present invention, the paper-shaped article is made of at least one high freeness composite for increasing the freeness and the drainability of the composite.

Figure 4:
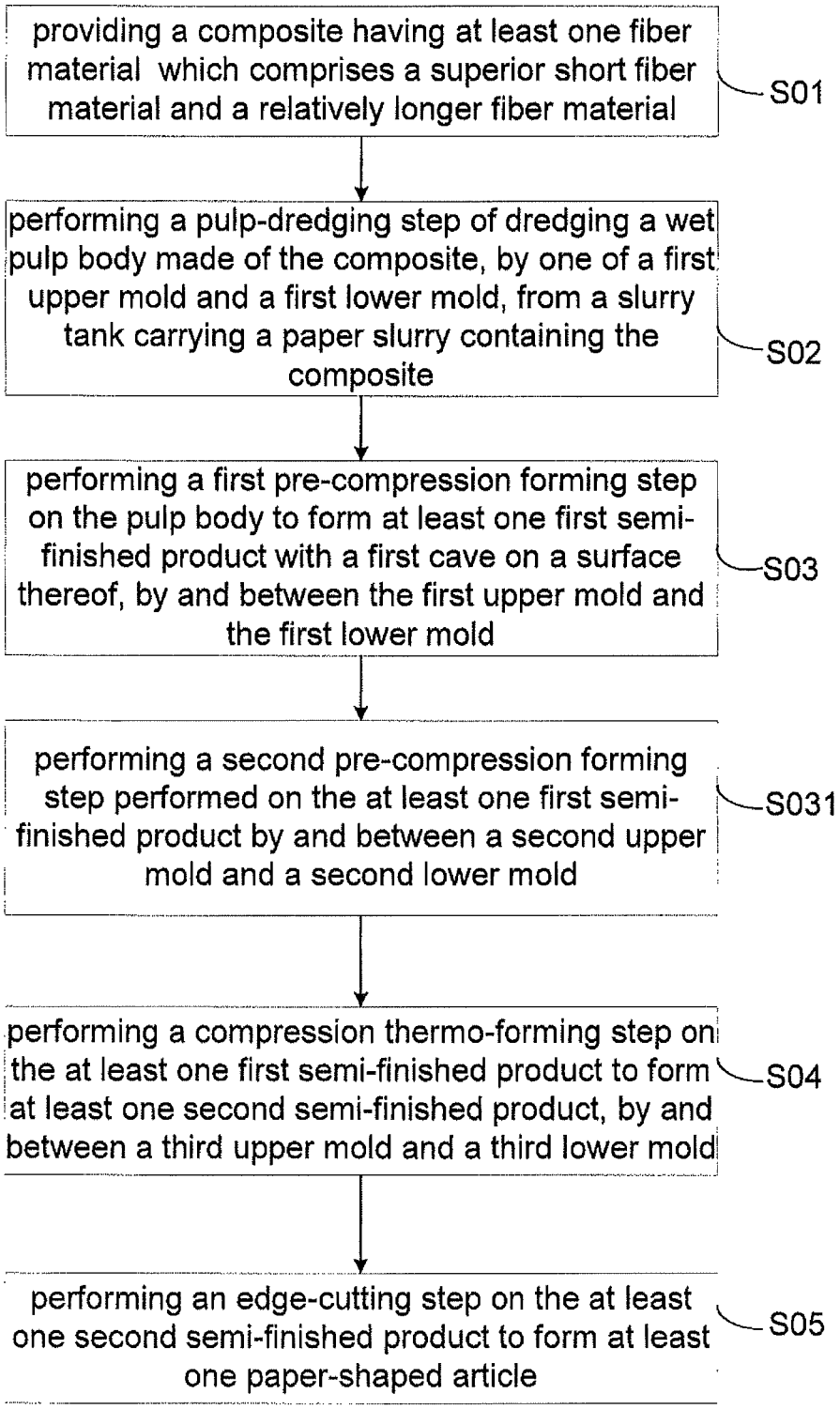
FIG. 4 is a flowchart of a pulp molding process according to a second embodiment of the present invention.
Figure 5:
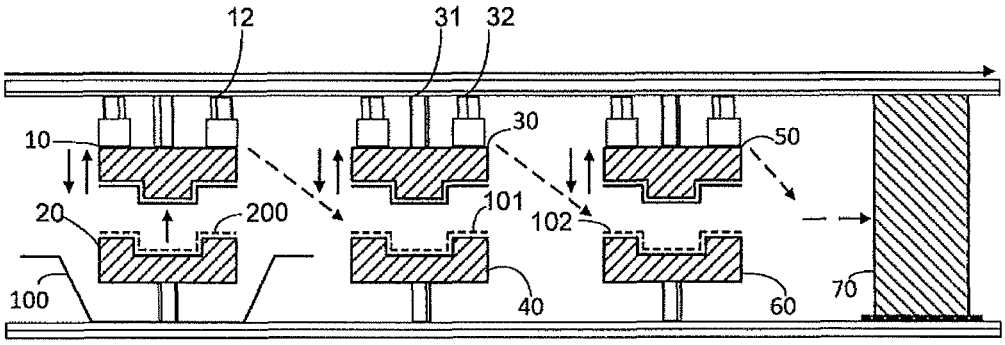
FIG. 5 is flowchart of a pulp molding process according to the second embodiment of the present invention, which includes a pulp-dredging step, a first pre-compression forming step, a second pre-compression forming step, a compression thermo-forming step, and an edge-cutting step of the pulp molding process, for forming a paper-shaped article.

Referring to FIG. 4, which is a flowchart of a pulp molding process according to a second embodiment of the present invention, and referring to FIG. 5, which is a flowchart of a pulp molding process according to the second embodiment of the present invention, which includes a pulp-dredging step, a first pre-compression forming step, a second pre-compression forming step, a compression thermo-forming step, and an edge-cutting step of the pulp molding process, for forming a paper-shaped article.

The difference between the second preferred embodiment and the first preferred embodiment is that before the compression thermo-forming step S04 and after the first pre-compression forming step S03, the process further comprises a second pre-compression forming step S031 applied on the at least one first semi-finished product 101 by and between a second upper mold 30 and a second lower mold 40.

More specifically, the first semi-finished product 101 is suctioned by the first upper mold 10, and the first upper mold 10 is moved upward to an initial position of the first pre-compression forming step. Next, the first upper mold 10 with the first semi-finished product 101 is horizontally conveyed by the first horizontal sliding rack 12 to place the first semi-finished product 101 over the second lower mold 40, instead of the third lower mold 60 of the first preferred embodiment. Then, the second upper mold 30 is moved downward by a second vertical sliding rack 31 in a close manner to the second lower mold 40, accompanied with applying a second compressing force on the first semi-finished product 101 by and between the second upper mold 30 and the second lower mold 40, both kept in the second molding gap therebetween and less than the first molding gap.

Simultaneously, the first semi-finished product 101 is heated by a heater (not shown) located above the second lower mold 40, drawing the water/vapor out from the first semi-finished product 101 between the second upper and second lower molds 30, 40, so as to form the first semi-finished product 102. Then, the second upper mold 30 with the first semi-finished product 102 is conveyed to perform the compression thermo-forming step by a second horizontal sliding rack 32.

Thus, the second pre-compression forming step can increase the drying efficiency of the first semi-finished product 101 and reduce the time consumption of processing the following compression thermo-forming step in thermo-forming the second semi-finished product 102.

Referring to FIGS. 6A-6D, which are schematic views of a transversal width of a cave of an object made by the pulp molding process according to the second embodiment of the present invention, including a pulp-dredging step, a first pre-compression forming step, a second pre-compression forming step, and a compression thermo-forming step of the pulp molding process, for forming a paper-shaped article. Also refer to FIG. 7, which is a schematic view of the paper-shaped article made by the pulp molding process according to the present invention.

In a conventional molding process and molding articles made thereby, a crosslinking effect always occurs to form a crosslinking portion in the cave/groove 3 (shown in FIG. 1), so that the wet pulp 5 (shown in FIG. 1) does not form a cave at the position of the molding article corresponding to the cave/groove 3 rather than forming a crosslinking portion 4 (the dotted line shown in FIG. 1).

Unlike the conventional molding process and molding article, the pulp molding process according to the present invention mentioned above can solve the technical problem of the conventional molding process and molding articles made thereby. Moreover, a paper-shaped article 80 (shown in FIG. 7) made by the pulp molding process according to the present invention does not have the crosslinking portion produced by the crosslinking effect. The paper-shaped article 80 (shown in FIG. 7) composed by a composite having at least one fiber material as mentioned above can solve the technical problem of the crosslinking effect. In this embodiment, the paper-shaped article 80 comprises a fourth cave 1021 (shown in FIG. 6D) having a transversal width w4 equal to or greater than 0.5 mm but less than or equal to 8 mm, and preferably greater than or equal to 6 mm and less than or equal to 8 mm.

Referring to FIG. 7. The paper-shaped article 80 further comprises: a smooth inner surface 81 having a surface smoothness of the inner surface about 8-10 seconds (according to Bekk Smoothness measurement); a smooth outer surface 82 having a surface smoothness of the outer surface about 7-9 seconds (according to Bekk Smoothness measurement) so that the paper-shaped article 80 manufactured by the pulp molding process according to the present invention is highly aesthetic.

Furthermore, a thickness of the paper-shaped article 80 is 0.5 mm to 3 mm.

Figure 6A:
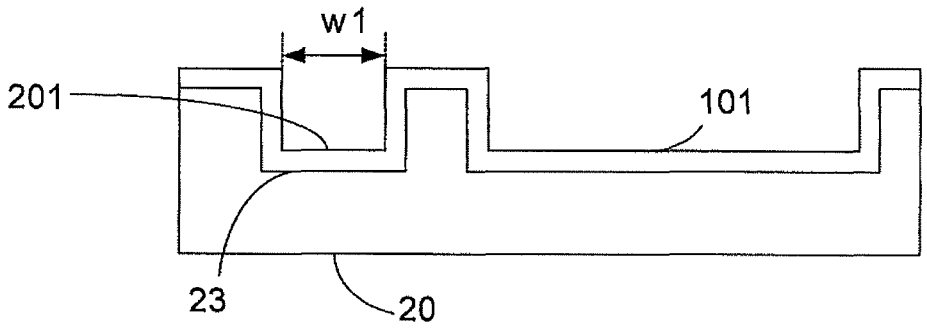
FIG. 6A-6D are schematic views of a transversal width of a cave of an object made by the pulp molding process according to the second embodiment of the present invention, including a pulp-dredging step, a first pre-compression forming step, a second pre-compression forming step, and a compression thermo-forming step of the pulp molding process, for forming a paper-shaped article.

Referring to FIG. 6A and FIG. 3, in the first pre-compression forming step, the first semi-finished product 101 formed on a surface of the first lower mold 20 comprises the first cave 201 having a transversal width w1 greater than 0 mm and less than 8 mm. It is noted that the first lower mold 20 has a shallow cave 23 corresponding to the first cave 201 of the first semi-finished product 101. A transversal width (inner diameter) of the shallow cave 23 is 1 mm to 8 mm.

Figure 6B:
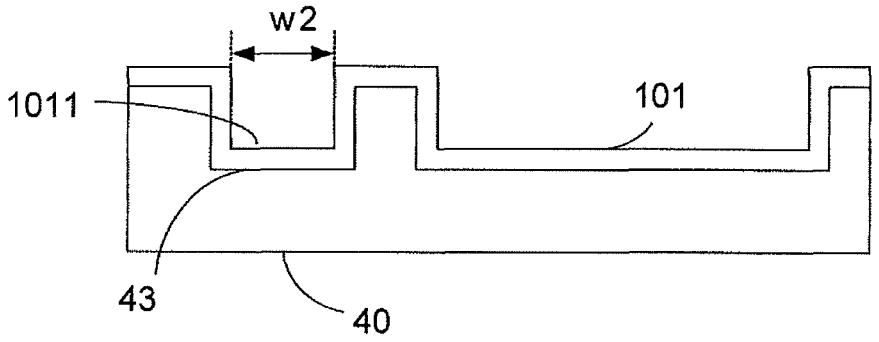

Referring to FIG. 6B and FIG. 3, in the second pre-compression forming step, the first semi-finished product 101 placed on the surface of the second lower mold 40 comprises a second cave 1011 having a transversal width w2 of from 6 mm to 8 mm. It is noted that the second lower mold 40 has a shallow cave 43 corresponding to the second cave 1011 of the paper-shaped article 80 or corresponding to the second cave 1011 of the first semi-finished product 101. A transversal width (inner diameter) of the shallow cave 43 is 1 mm to 8 mm.

Figure 6C:
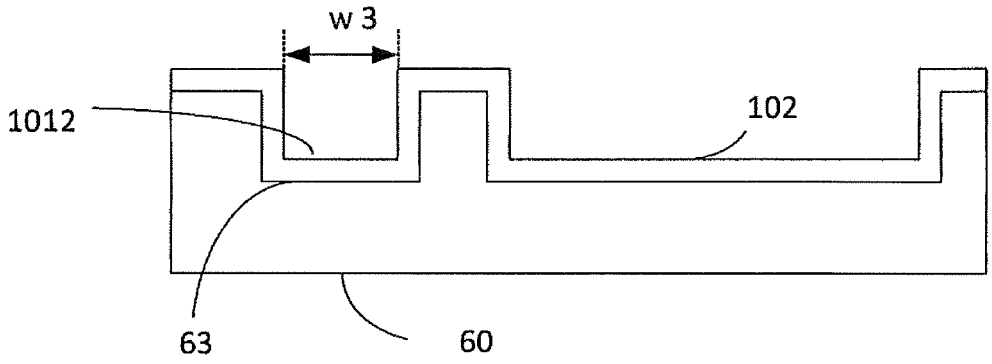

Referring to FIG. 6C and FIG. 3, in the compression thermo-forming step, the first semi-finished product 101 placed on the surface of the third lower mold 60 comprises a third cave 1012 having a transversal width w3 of from 6 mm to 8 mm. It is noted that the third lower mold 60 has a shallow cave 63 corresponding to the third cave 1012 of the second semi-finished product 101. A transversal width (inner diameter) of the shallow cave 63 is 1 mm to 8 mm.

Figure 6D:
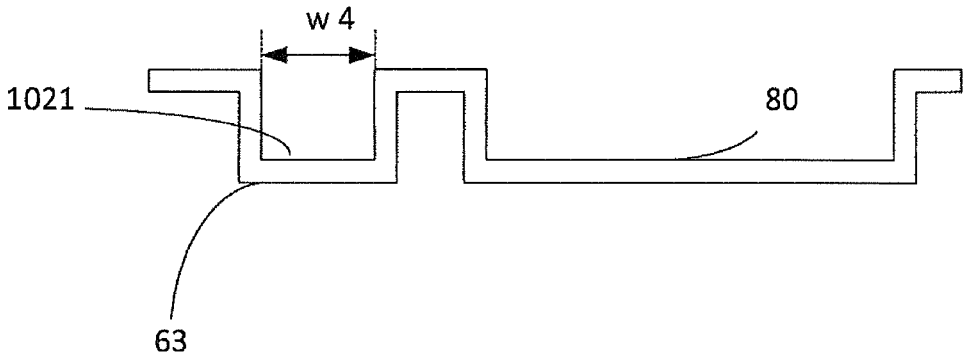

Referring to FIG. 6D and FIG. 3, after performing the compression thermo-forming step, the at least one second semi-finished product 102 placed on the surface of the third lower mold 60 is to be performed the edge-cutting step to form at least one paper-shaped article 80 with the fourth cave 1021 wherein the fourth cave 1021 has a transversal width w4 of from 0.5 mm to 8 mm.

The present invention has disclosed that the pulp molding process and the paper-shaped article made by the pulp molding process are able to solve the problem of the crosslinking effect of the dredged pulp body dredged up by the first lower mold from the paper slurry during the pulp-dredging step and achieving a desirable combination of strength and the surface smoothness of the inner surface and the outer surface suited for the paper-shaped article.

The present invention has been described with preferred embodiments thereof, and it is understood that many changes and modifications to the described embodiments can be carried out without departing from the scope and the spirit of the invention that is intended to be limited only by the appended claims.

What is claimed is:

1. A paper-shaped article made by a pulp molding process, comprising:

a smooth inner surface having a surface smoothness of the inner surface about 8-10 seconds according to Bekk Smoothness measurement;

a smooth outer surface having a surface smoothness of the outer surface about 7-9 seconds according to Bekk Smoothness measurement; and wherein the smooth inner surface is formed with at least one cave having a transversal width equal to or greater than 0.5 mm but less than or equal to 8 mm, the paper-shaped article comprises a composite having at least one fiber material, the composite comprises 20 to 99 parts by weight of a superior short fiber material, and a fiber length of the superior short fiber material is greater than 0 mm and less than or equal to 0.8 mm.

2. The paper-shaped article according to claim 1, wherein a thickness of the paper-shaped article is 0.5 mm to 3 mm.

3. The paper-shaped article according to claim 1, wherein the superior short fiber material is selected from the group consisting of synthetic fibers, regenerated fibers, nature fibers, microfibers, nanofibers and/or any combinations thereof.

* * * * *